US005448901A

United States Patent [19]

Yu et al.

[11] Patent Number: 5,448,901

[45] Date of Patent: Sep. 12, 1995

[54] METHOD FOR CONTROLLING AXIAL SHIFTING OF ROLLS

[75] Inventors: Qiulin Yu; Kuan-Chen Fu, both of Toledo, Ohio

[73] Assignee: The University of Toledo, Toledo, Ohio

[21] Appl. No.: 237,058

[22] Filed: May 3, 1994

[51] Int. Cl.[6] ..... B21B 31/18; B21B 37/00

[52] U.S. Cl. ..... 72/8; 72/11; 72/21; 72/247; 364/472

[58] Field of Search ..... 72/8–12, 72/16, 21, 241.4, 241.8, 247, 365.2, 366.2; 364/472

[56] References Cited

U.S. PATENT DOCUMENTS

| | | | |
|---|---|---|---|
| 4,651,547 | 3/1987 | Morel et al. | 72/8 |
| 4,770,021 | 9/1988 | Kobayashi et al. | 72/247 |
| 4,800,742 | 1/1989 | Feldmann et al | 72/247 |
| 4,813,256 | 3/1989 | Engel | 72/21 |
| 4,898,014 | 2/1990 | Ginzburg et al. | 72/247 |
| 4,934,166 | 6/1990 | Giacomoni | 72/247 |
| 4,955,221 | 9/1990 | Feldmann et al. | 72/247 |
| 5,174,144 | 12/1992 | Kajiwara et al. | 72/236 |
| 5,231,858 | 8/1993 | Yamashita et al. | 72/12 |

*Primary Examiner*—Lowell A. Larson
*Assistant Examiner*—Thomas C. Schoeffler
*Attorney, Agent, or Firm*—Marshall & Melhonr

[57] ABSTRACT

A system for controlling axial shifting of working rolls on a rolling mill is provided, and more particularly, a control system method which includes monitoring sensors for the rolling mill, processing information and calculating the non-all statical friction condition for the contact surfaces of the rolls on a central processing unit, and implementing the axial shifting of the working rolls on a hydraulic system. The purposes of roll shifting are primarily to control the strip shape and crown by improving the bending roll effect, to reduce the edge drop of the strip, and to maintain the uniform wear and thermal crown of the working rolls. In order to minimize or eliminate the scarring and scotch marks caused by axial shifting of the rolls, the contact zone must be kept in a non-all statical friction state. The non-all statical friction condition may be met by controlling the shifting velocity. In the control system of the present invention, the shifting distance of the roll and the shifting velocity of the cylinder are controlled in a closed loop system. Because the setting accuracy when shifting rolls directly influences the strip shape quality, the closed loop of roll position is taken as the outer loop of the system and shifting velocity is established as the inner loop. Displacement transducers and velocity transducers are used to generate control signals base on the actual shifting distance and actual shifting velocity.

6 Claims, 7 Drawing Sheets

METHOD FOR CONTROLLING AXIAL SHIFTING OF ROLLS

BACKGROUND OF THE INVENTION

1. Field of the Invention

The present invention relates to a control system for use on a rolling mill, and more particularly, to a control system and method in which the shifting distance and the shifting velocity of at least one working roll in the rolling mill are calculated and controlled by the requirements of both the shape of the strip being processed on the rolling mill plus the non-all statical friction condition on the contact surfaces of the strip and the rolls.

2. Summary of Related Art

The quality of cold-rolled thin-gage strip has increased considerably over the past few years in order to meet the quality demands of large users of strip metals, such as the automotive and appliance users. Strip shape is an important criterion for judging strip quality, and many techniques have been devised for controlling the strip shape during rolling mill production operations.

An ideal cold-rolled strip not only is to exhibit the same thickness over length and width, but also is to lie completely planar. Planeness should be preserved, even if the strip is cut into sections during further processing.

The requirements with respect to dimensional accuracy and planeness of a thin-gage strip have presented significant problems for steel and other metal processors. Certain flaws in planeness can be levelled by stretching, such as where the strip deviates uniformly from planeness in the width direction. Flaws in evenness that can be levelled by stretching are characterized in that they are generally delimited in one direction, i.e. in the longitudinal direction or in the transverse direction.

Deviations in planeness variable over the strip width and length are characterized by curved boundaries and cannot be stretched level by means of a simple bending process. In such case, non-uniform residual stress distributions are present in the longitudinal and transverse directions. The variable flaws appear as central and marginal wariness in the cold-rolled strip. The high requirements regarding the quality of rolled, thin-gage metal strip have resulted in increased interest in rolling mill systems and controls.

A rolling mill generally includes a supporting stand with at least two working rolls which bear on at least two back-up rolls. The rolls are carried at their two ends by means of rolling bearings, in chocks slidably mounted in the windows of the rolling mill supporting stand. Each chock typically includes two lateral guide faces sliding along corresponding sliding faces formed on the upright of the stand on either side of the chock.

A four-high rolling mill includes two working rolls each bearing on a back-up roll. A six-high rolling mill is provided with intermediate rolls between the back-up rolls and working rolls. In both cases, the axes of the rolls are place in the generally vertical gripping plane. Each working roll can also bear a larger number of intermediate and/or back-up rolls arranged symmetrically on either side of the gripping plane.

To obtain a uniform thickness in the direction transverse to the rolling direction, the bending or curving of the working rolls and, if appropriate, of the intermediate rolls, is carried out by means of bending devices acting on the chocks of the corresponding roll. The bending device for each chock generally consists of two sets of jacks arranged symmetrically on either side of the chock. Each bearing part of the chock bears on the two jacks set axially apart from one another symmetrically on either side of the mid-plane of the rolling bearing of the chock, so that the bending force is effectively distributed over the rolling bearings.

In four-high and six-high rolling mills, it is often advantageous to axially shift the rolls in order to achieve various objectives, including uniformity of the wear of the rolls and control of the planeness or profile of the metal strip. The edge of the strip causes wear on the surface of the roll during rolling, and the wear on the roll can be evened out by axially moving the roll.

The axial shifting of the rolls presents certain difficulties when the rolls are subject to a bending force. Consequently, the bending force and the axial shifting force are usually carried out separately, the bending force being stopped when the axial shifting takes place. During operation of the rolling mill, it is desirable to combine the effects of axial shifting the rolls and of bending the rolls. Consequently, it is also desirable to shift the rolls while continuing to bend the rolls.

A rolling mill for rolling metal strip uses small diameter working rolls. Since such working rolls have too small a diameter for application of the rolling torque directly to them, a number of multi-roll rolling mills have been developed in which the drive force is transmitted to the working rolls. The working rolls used to process the metal strip deflect between their oppositely held ends when the center portion of the roll is engaged by the metal strip. This deflection results in unacceptable product conditions due to its affect on the uniformity of the cross section and flatness of the strip and edge reduction.

Attempts have been made in the rolling mill industry to eliminate some of the adverse conditions in the rolling process. Vertical roll bending forces have been applied to the working rolls and the backup rolls. Special shaped working rolls and/or back up rolls, including fluid expandable rolls, have been used. Axial shifting of rolls has also been utilized to overcome the quality problems in production. In most cases, a combination of roll bending and roll shifting provides a reasonable solution to the irregular thickness problems of the metal strip.

The shifting of working rolls during production operations facilitates schedule-free rolling. Previously, working rolls were subject to unbalanced abrasion owing to the presence of the lateral edges of the rolled sheet material. This limited the number of same width strips which could be rolled consecutively. Operators often utilized a coffin schedule in which strips were rolled with the widths of the strips progressively narrowing.

In contrast, schedule free rolling permits rolling of any width strip by axially shifting the rolls to eliminate the unbalanced abrasion of the rolls. No limitations are placed on the order of selection of the widths of the strip. Strip products of the required width can be run based on product demand, and rolling mills can be included as in integral part of a production facility for producing the desired strip rolls.

U.S. Pat. No. 4,770,021 to Kobayashi et al. discloses a working roll shift type rolling mill which includes a shift device for shifting the working rolls in an axial direction and hydraulic cylinders for effecting a working roll bending pressure. Shift cylinders are used to shift the working rolls based on production time factors.

Axial shifting of working rolls in a rolling mill is also disclosed in U.S. Pat. Nos. 4,800,742 and 4,955,221 to Feldmann et al. The roll bodies are continuously curved over the entire length of the bodies. The shifting of the work rolls controls the shape of the gap between the two working rolls.

A control system is disclosed in U.S. Pat. No. 4,898,014 which controls the balance force exerted by a cylinder, which otherwise changes on the shifting of an associated roll. The control system includes a means for determining the amount of roll shifting, a second means, operatively associated with the first means, for determining the amount of change in the force imposed by the balance cylinder caused by the shifting, and a third means, responsive to the second means, for effecting a change in the balance force to maintain the force at a predetermined value.

U.S. Pat. No. 4,934,166 to Giacomoni discloses a rolling mill configuration which facilitates the simultaneous bending and axial shiftini of the work rolls. Each set of jacks furnished for the rolling mill bears in the direction of the bending force on a sliding piece mounted so as to slide vertically between two pairs of guide faces which are formed in a machined portion produced inside the supporting block. A sensor detects and measures the axial shifts, and sends a signal to a processor. The processor controls a servo valve to adjust the bending pressure of the working rolls.

In U.S. Pat. No. 5,174,144 to Kajiwara, a 4-high rolling mill is disclosed in which an equivalent crown amount can be increased and decreased to a desired value by an axial shift of the work rolls. The rolling mill includes a roll bending device for applying a bending force to the upper and lower work rolls, and a roll shift device for shifting the upper and lower work rolls in an axial direction.

One of the problems which occurs in axially shifting the work rolls is the scarring or scotch marks on the working rolls and the strip material. When a roll is shifted any distance in its axial direction, a friction force is produced in the contact zone of the roll surface. If the friction force is greater than its maximum statical friction force, the zone is in a slip state, which may produce scarring and scotch marks on the surface of the roll, which damages both the surface of the roll and the surface of the strip material. If the roll is damaged so that defects in the strip material occur during future rolling operations, the working roll will have to removed and repaired for future use. Any damage to the strip material presents a major problem and should be avoided. In addition to the scarring and scotch marks on the strip material, the friction force may even cause strip tearing, which creates production and product quality problems.

In an effort to improve overall quality of the strip being produced, rolling mill operators desire a control system to minimize or eliminate the scarring and scotch marks in the working rolls caused by axial shifting of the working rolls.

SUMMARY OF THE INVENTION

In accordance with the present invention, there is provided a system and method for controlling axial shifting of working rolls on a rolling mill, and more particularly, to a control system which includes sensors for monitoring the rolling mill, processors for processing information and calculating the non-all statical friction condition on the contact surfaces of the rolls, and a hydraulic system for implementing the axial shifting of the working rolls.

The purposes of roll shifting are primarily to control the strip shape and crown by improving the bending roll effect, to reduce the edge drop of the strip, and to maintain the uniform wear and thermal crown of the working rolls. Axial shifting of the rolls is performed by hydraulic cylinders typically mounted at one end of the rolls, the hydraulic cylinder being controlled by a standard hydraulic control system.

In controlling the axial movement of a roll, the three main control parameters are as follows: (a) the axial shifting distance, (b) the velocity of the shifting roll, and (c) the axial force applied to shift the roll. In the prior art, the only control used in the shifting process was the shifting distance. The controller of the present invention monitors and controls the axial shifting distance and the velocity of the shifting roll to avoid the scarring and scotch marks caused by the shifting.

It is well known that a slip state exists in a relative movement between two objects, but under particular conditions, the slip state can be avoided. In order to minimize or eliminate the problems caused by axial shifting of the rolls, the contact zone must be kept in a non-all statical friction state, such that the frictional force at every point in the contact zone must be less than the maximum statical friction force.

Each strip mill, in various adjustable states, has its own permissible shifting velocity to achieve non-all statical friction state. During the axial shifting process, the hydraulic control system has difficulty in simultaneously delivering the required axial shifting distance and the required axial shifting force because these two variables are correlative. However, the non-all statical friction condition may be met by controlling the shifting speed. As a result, the two control variables used in the present invention are the axial shifting distance and the velocity of the shifting roll, because these two control variables are generally independent.

The permissible shifting velocity of a roll is determined by a number of roll parameters, such as rotational speed of the roll, the radius of the roll, the surface roughness and texture, the limit initial displacement, and the width of the contact zone. The range of the permissible shifting velocity changes as the roll parameters change.

The hydraulic control system used in a majority of the rolling mills with axial shifting of the working rolls includes a hydraulic servo closed loop control system. The only control variable in such a hydraulic servo control system is shifting distance, which is used to control the strip shape.

In the present invention, the control variables include both the shifting distance and the shifting velocity of the roll determined by the requirements of not only the strip shape, but also the non-all statical friction condition. The closed loop of the shifting velocity is established as the inner loop. Because the setting accuracy when shifting rolls directly influences the strip shape quality, the closed loop of roll position is taken as the outer loop of the system. Displacement transducers and velocity transducers are used to generate control signals base on the actual shifting distance and actual shifting velocity.

An object of the present invention is to develop a system and process to monitor and control the shape of the strip being processed in the rolling mill, and to improve the quality of the strip by minimizing the scotch marks which occur on the strip during the axial shifting of the rolls.

A further object of the present invention is to define the control parameters for the non-all statical friction condition and to provide a means for calculating the permissible shifting velocity range when axially shifting the rolls of the rolling mill. An additional object of the present invention is to improve the method of shifting the rolls of the rolling mill without having any adverse impact on the shape or quality of the strip being processed.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
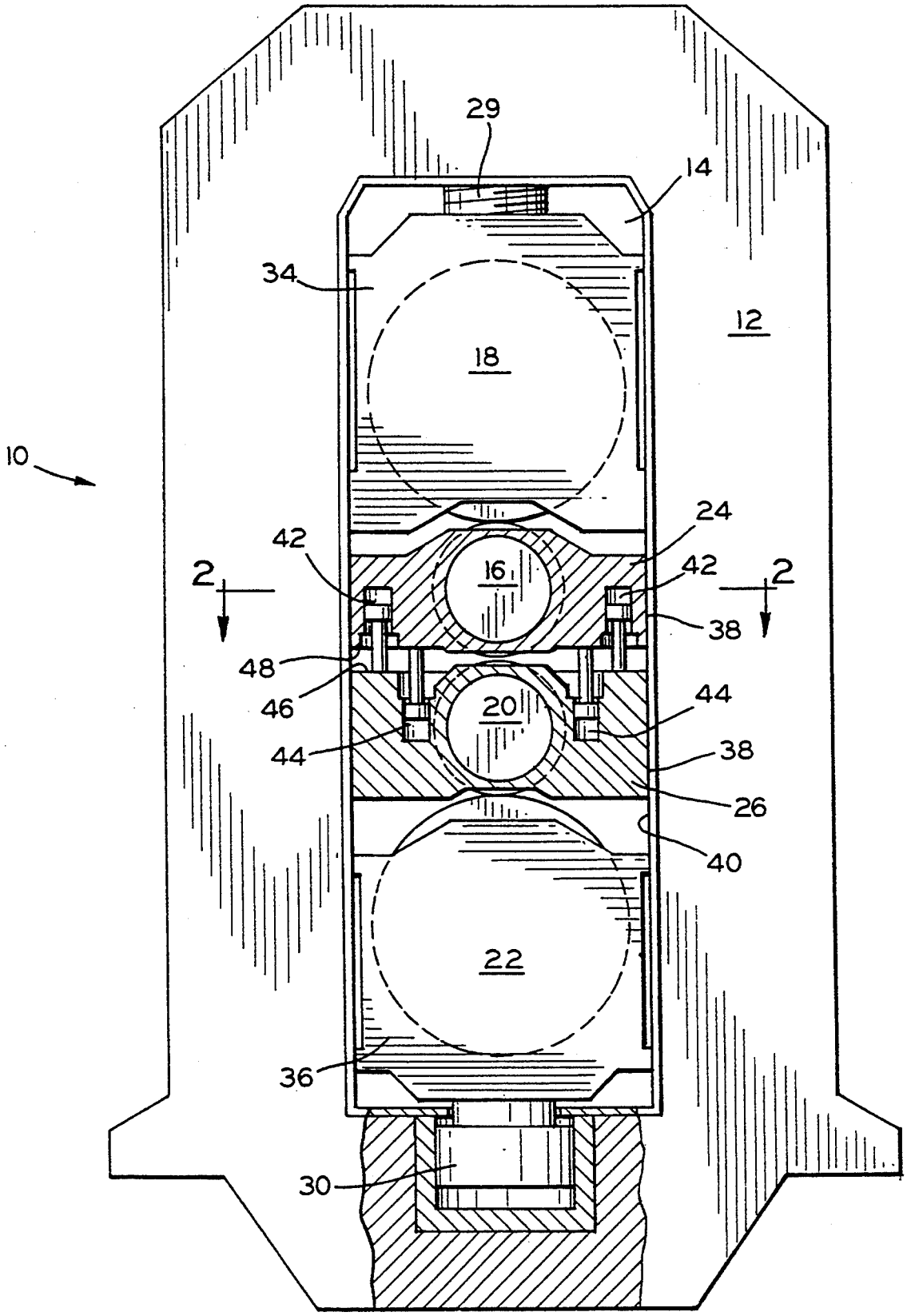
FIG. 1 is a front elevational view of a preferred embodiment of a working roll shift type four-high rolling mill in accordance with the present invention.

Referring now to the drawings, there is shown in FIG. 1 a four-high rolling mill 10 in accordance with the present invention. The general structural components and the operating relationships of the mill are known in the art, as evidenced by the patents referenced above.

The rolling mill 10 includes a housing 12 having a vertically extending window 14 for receiving and retaining the upper and lower roll sets. The upper roll set consists of upper work roll 16 and upper back-up roll 18, and the lower roll set includes lower work roll 20 and lower back-up roll 22.

Figure 2:
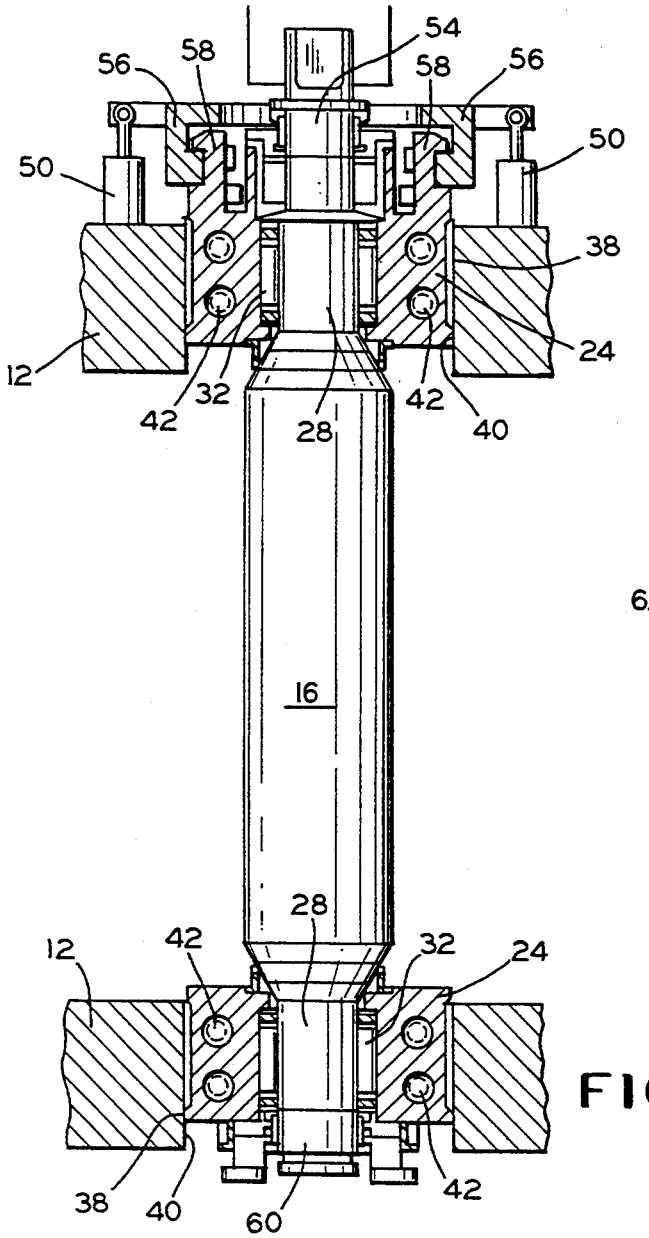
FIG. 2 is a view taken along line 2—2 of FIG. 1.

As shown in the FIGS. 1–2, upper and lower metal chocks 24, 26 are used to rotatably support the outer end journals 28 of the upper and lower work rolls, 16, 20. The chocks 24, 26 are slidably retained within the window 14. In other rolling mill designs, additional project blocks may be used to secure the chocks in the window 14 of the mill housing 12. Roller bearings 32 are used to center the journals 28 of the work rolls 16, 20. The upper and lower back-up rolls 18, 22 are similarly mounted by chocks 34, 36 in the window 14 of housing 12. The upper and lower back-up rolls 18, 22 are moved upward and downward in window 14 by a by a housing screw 29 and a reduction cylinder 30.

The upper and lower chocks 24, 26 are furnished with sliding faces 38 which slidably engage the corresponding faces 40 of the window 14 in the housing 12. Each chock 24, 26, guided between the two vertical faces, can be shifted in two directions, both vertically under the action of the roll bending device and parallel to the axis of the roll under action of the axial action adjustment device.

FIGS. 1–2 also show a plurality of hydraulic cylinders 42, 44 respectively incorporated in vertically facing upper and lower working roll chocks 24, 26. The hydraulic cylinders are arrange to apply bending forces to the upper and lower working rolls 16, 20. The eight cylinders 42 are disposed in the lower portion of upper chock 24 and are brought into contact with the top surface 46 of the lower chock 26. When the piston shafts of the cylinders 42 are extended vertically, the cylinders 42 act to push up the upper working roll chock 24. The second set of eight hydraulic cylinders 44 are similarly disposed in the upper portion of the lower chock 26, and are brought into contact with the bottom surface 48 of the upper working roll chock 24. The vertical forces generated by the hydraulic cylinders 44 act to push down the lower working roll chock 20.

The upper working roll 16 and the lower working roll 20 can be bent by controlling the position of the hydraulic cylinders 42, 44, and the bending of the working rolls 16, 20 controls the thickness and profile of the strip material being processed in the rolling mill 10. The cylinders 42, 44, according to usual practice, serve a dual function. The roll bending occurs when the cylinders apply a negative or positive force to the chocks 24, 26 at the end of the work rolls 16, 20, which deflects the bodies of the rolls 16, 20 to achieve shape and/or profile control of the strip material. The chocks 24, 26 slide in a vertical direction within the window facing 40. The second function is referred to as roll balancing, where the necessary separating force is applied under a no-load condition to maintain the desired roll gap.

Figure 2A:
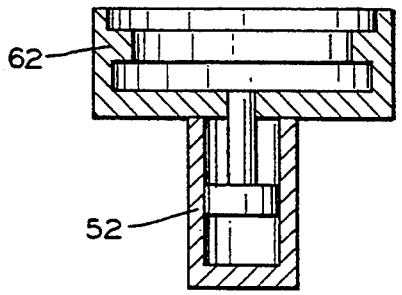
FIG. 2A is a bearing cap and hydraulic cylinder for installation on the chock of the working roll.

Various devices have been developed for the axial shifting of the working rolls 16, 20. The axial shifting force exerted on one of the chocks should be exerted along the axis of the roll. In FIG. 2, the axial shifting force is provided by two hydraulic cylinders 50 on the drive end of the upper working roll 16. FIG. 2A shows a device for axial shifting which utilizes a single hydraulic cylinder 52. The axial force is typically applied on only one end of the working rolls 16, 20 to minimize costs, but rolling mills are occasionally provided with cylinders on both ends with a synchronized controller.

On the drive end of the upper working roll 16, a coupling 54 connects the roll 16 to an electrical drive system. A single hydraulic cylinder, as a result of the coupling 54, is not generally appropriate because the cylinder cannot be mounted in-line with the center axis of the roll 16. Instead, two cylinders 50 are controlled in synchronism and mounted symmetrically on either side of the coupling 54. A number of different mounting collars 56 or shift beams are used to secure the hydraulic cylinders 50 to the extension 58 of the upper working roll chock 24. When the cylinders 50 are actuated, the axial shifting force exerted by the cylinders 50 is transmitted to the working roll 16 and the second chock 24 at the other end of the working roll 16 such that the chocks 24 and roll 16 are shifted axially in the housing 12.

In FIG. 2A, an alternative axial drive system for a single hydraulic cylinder 52 is shown, which can be mounted on the non-drive end 60 of chock 24 in combination with or in lieu of the cylinders 50 on the drive end. The cylinder 52 is connected to a bearing cover 62 which can be symmetrically secured to the end 60 of chock 24. The shifting force from cylinder 52 is transmitted along the axis of roll 16 to shift the chocks 24 and the roll 16.

Figure 3:
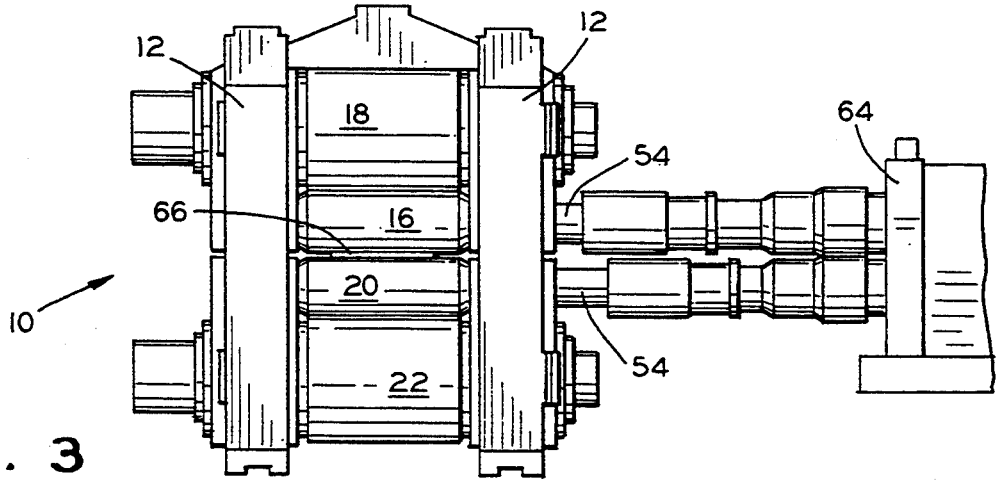
FIG. 3 is a side elevational view of the rolling mill shown in FIG. 1.

FIG. 3 shows a front view of the typical four-high rolling mill 10 with housing 12. The working rolls 16 and 20 are coupled by couplings 54 to a pinion stand and electric motor drive system 64. The strip material 66 is processed through the mill 10 between the two working rolls 16, 20.

The vertical bending forces applied to the chocks of a working roll bend the working roll to control the shape and profile of the strip. The axial forces applied to the chocks of a working roll shift the roll to control the shape and profile of the strip and to maintain uniform wear on the rolls. Axial shifting control may be achieved by rolling mills with different structural features and/or configuration of parts. The various rolling mill configurations will not be discussed in detail.

The axial shifting control system of the present invention may be applied to any rolling mill utilizing axial shifting of rolls, including rolling mills with from four-high to twenty-high configurations, or greater. The primary applications include four-high and six-high strip mills, such as the four-high HCW mill with shifting flat work roll, the 6-high HCM mill with shifting flat middle work roll, the four-high K-WRS mill with shifting taper work roll, and the four-high CVC mill with shifting curvilinear work roll.

The present invention is suitable for both hot roll and cold roll mills. The strip material 66 can be any type of metal material to be processed, such as steel, aluminum, copper, and related alloy metals. Rolling mills processing non-metal materials may also utilize the control system if axial shifting of the rolls is required.

As noted above, the essential function of axially shifting the working rolls of a mill may cause quality problems because of the scarring and scotch marks caused by sliding metal on metal. The rolling mill control systems presently in use monitor and control the axial shifting distance through the use of position transducers or other similar displacement sensors. Such systems have not been effective in minimizing the problems caused by scarring and scotch marks.

In the control system of the present invention for controlling the axial shifting of rolls, three key parameters are considered in connection with the minimization of the scarring and scotch marks, such parameters being as follows: (1) the axial shifting distance, (2) the velocity of the roll during the axial shifting, and (3) the force applied to accomplish the axial shifting.

It is well known that a slip state exists in a relative movement between two objects, but under certain conditions, the slip state can be avoided. When a roll of a rolling mill is shifted any distance in its axial direction, a friction force is produced in the contact zone of the roll surface. If the frictional force is greater than the maximum statical friction force, the contact zone is in a slip state, which may produce hazardous scarring and scotch marks on the surface of the roll and the strip being processed.

In order to avoid such problems during roll shifting, the contact zone must be kept in a non-all statical friction state. The adjustable parameters of the axial shifting process are processed in the control system of the present invention in order to achieve this desired state.

Figure 4:
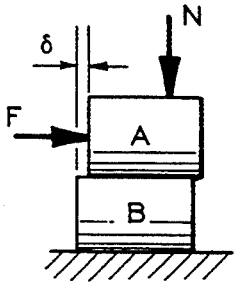
FIG. 4 illustrates the initial displacement between two objects.

The initial displacement principle is used to evaluate the friction state on the contact surface of two objects by the relative displacement. FIG. 4 shows metal objects A and B having machined surfaces in contact with each other. When a positive vertical force N and a horizontal force F are applied to object A, and if the force F is less than the maximum statical friction force, object A produces a small displacement $\delta$, which is called the initial displacement. In fact, the displacement is the elastic deformation of the surface produced by the horizontal force F. The friction state under this condition is defined as the non-all statical friction state.

According to the initial displacement principle, under the non-all statical friction condition, the initial displacement can be expressed as follows:

$$\delta=\delta_0[1-(1-\beta)^{\alpha}] \quad (1)$$

where $\beta=\tau_0/(fq)$, and $\alpha=2/(2\mu+1)$, $\delta_0$=the limit initial displacement of the contact surface, q=the unit normal pressure of the contact surface, $\tau_0$=the axial shear stress of the contact surface, f=the statical friction coefficient, and $\mu$=the surface roughness coefficient (when the surface roughness of cylindrical grinding is in the range between grades 7 and 10, $\mu$=2.0 to 1.9.

Figure 6:
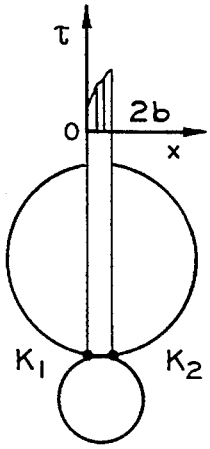
FIG. 6 is a side view of the working roll and back-up roll shown in FIG. 5.
Figure 5:
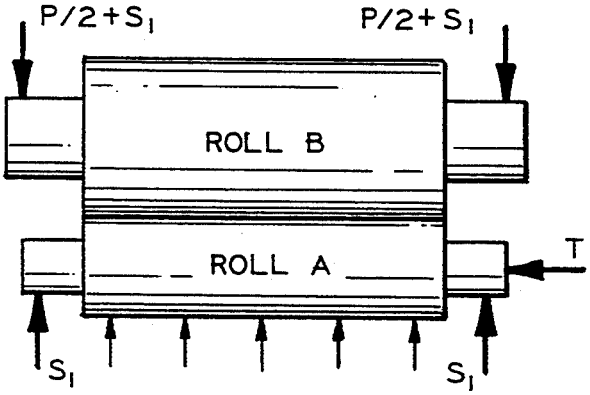
FIG. 5 is a front view showing the contact state between a working roll and a back-up roll.

With two rolls rotating, the distribution of the shear stress in the contact zone and the initial displacement at the exit point of the contact zone are variable. The roll shifting is caused by the initial displacement. In FIGS. 5–6, it is assumed that roll B is fixed and that roll A can be shifted in the axial direction. The contact width of rolls A and B in FIG. 6 is shown as 2*b*. The average unit of normal pressure and axial shear stress in the contact zone are q and $\tau_0$ respectively. When the two rolls are rotating, exit point $K_2$ leaves the contact zone and loses the axial force. At the same time, entrance point $K_1$ enters the zone and obtains the axial force that is always less than the lost axial force, which results in the increase of the shear stress of the original contact zone. Thus, the axial force acquires a new equilibrium state. This state goes on and off repeatedly when roll A is shifted a distance in the axial direction. The scarring burrs and scotch marks on the contact surface assume a helical movement around the roll axis.

From equation (1), we obtain the relationship between the shear stress increment $d\tau$ and the axial displacement increment $d\delta$, which is as follows:

$$d\delta=\phi_0 d\tau/\tau_0 \quad (2)$$

where $$\phi_0=\alpha\beta\delta_0(1-\beta)^{\alpha-1}.$$

When exit point $K_2$ moves a distance dx of the first $2b$ width out of the contact zone, point $K_1$ enters the zone and obtains the shear stress increment $d\tau_1$, where $d\tau_1=\tau_0 dx/(2b)$.

The shear stress distribution of point $K_1$ is equal to the following:

$$\tau_1(x)=\tau_0 x/(2b). \quad (3)$$

When point $K_1$ reaches the position of point $K_2$, the axial shifting distance of roll A may be expressed in the following form:

$$\delta_1=\int_0^{2b}\phi_0 d\tau_1/\tau_0=\phi_0 \quad (4)$$

When point $K_1$ enters the second $2b$ width, the results are as follows:

$$d\tau_2=[\tau_0+\tau_0 x/(2b)]dx/(2b) \quad (5)$$

$$\tau_2(x)=\tau_0 x/(2b)+\tfrac{1}{2}\tau_0[x/(2b)]^2 \quad (6)$$

$$\delta_2=\int_0^{2b}\phi_0 d\tau_2/\tau_0=1.5\phi_0 \quad (7)$$

When point $K_1$ enters the "n"th $2b$ width, the parameters $d\tau_n$, $\tau_n(x)$, and $\delta_n$ are approximately expressed by the following recursive formulas:

$$d\tau_n=[\tau_{n-1}(2b)-\tau_{n-2}(2b)]x dx/(2b)^2+\tau_{n-1}(2b)dx/(2b) \quad (8)$$

$$\tau_n(x)=2^{2-n}\tau_0\{(2^{n-1}-1)x/(2b)+\tfrac{1}{2}[x/(2b)]^2\} \quad (9)$$

$$\delta_n=(2-2^{1-n})\phi_0 \quad (10)$$

Further, if $n\rightarrow\infty$, the shear stress and displacement can be represented in a stable state as follows:

$$\tau_\infty(2b)=2\tau_0 \quad (11)$$

$$\delta_\infty=2\phi_0 \quad (12)$$

Figure 7:
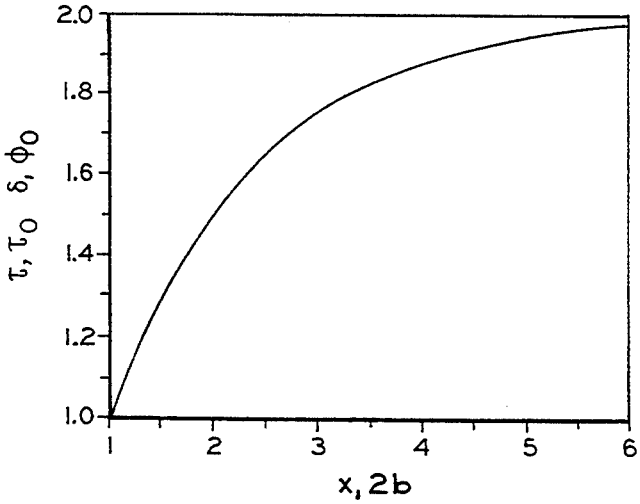
FIG. 7 is a graph showing the axial force and displacement at the exit point in a transient state.

From equation (9) and equation (10), the shear stress at the exit point and the axial displacement of every $2b$ width in a transient state can be shown in FIG. 7. After the rolls have been rotated several $2b$ widths, the shear stress and the axial displacement rapidly reach a stable state.

The axial shifting velocity of a roll can also embody the friction state on a contact surface. The axial shifting velocity is an important controlling variable of the control system used to control the hydraulic cylinders for shifting the rolls. If the rotational speed of roll A is $n_A$ rpm and the radius of roll A is $R_A$, the circular velocity can be stated as follows:

$$u_A=2\pi n_A R_A/60=0.10472 n_A R_A \quad (13)$$

From equation (12), the axial shifting velocity in a stable state is obtained as:

$$v_A=u_A\delta_\infty/(2b)=0.20944 n_A R_A\phi_0/(2b) \quad (14)$$

The equivalent pitch on the helical curve on the roll surface is as follows:

$$m_A=2\pi R_A\delta_\infty/(2b)=12.5664 n_A R_A\phi_0/(2b) \quad (15)$$

If roll B can also be shifted at the same speed in the opposite direction of roll A, the absolute axial shifting velocity is equal to:

$$v'_A=\tfrac{1}{2}u_A\delta_\infty/(2b)=0.10472 n_A R_A\phi_0/(2b) \quad (16)$$

The coefficient $\beta$ has some limiting values under various frictional conditions. In the case of the statical friction condition, $\beta<1$. In the case of the non-all statical friction condition, $\beta<0.5$, because the shear stress at the exit point is equal to $2\tau_0$, which also states that the axial shifting velocity has a permissible range. When $\beta=0.5$, the velocity reaches its maximum limit and equations (14) and (16) become as follows:

$$v_{Amax}=0.20944 n_A R_A\alpha\delta_0 0.5^\alpha/(2b) \quad (17)$$

$$v'_{Amax}=0.10472 n_A R_A\alpha\delta_0 0.5^\alpha/(2b) \quad (18)$$

Each type of strip mill in various adjustable states has its own permissible shifting velocity. According to the operating situations of the four-high and six-high strip mills and the type of contact zone, the adjustable states of the shifting roll can be summarized in five basic cases as shown in FIGS. 8A–8E. In each case, the factors influencing the limit velocities of the shifting roll differ depending on the contact surfaces. As a result, different contact zones have different limit velocities. In general, the shifting roll has one or two contact zones. In the case of two contact zones, the axial shifting velocities must be compatible, which requires the axial forces in the two contact zones to be apportioned.

In essence, the non-all statical friction requires that the friction force at every point must be less than the maximum statical friction force. It is difficult for a hydraulic control system to simultaneously deliver the required axial shifting distance and the required axial shifting force because these two control variables are correlative. However, considering equation (14), the non-all statical friction condition may be met by controlling the shifting speed. Thus, the control variables for the control system of the present invention become the axial shifting distance and the axial shifting velocity. These two control variables are relatively independent. In the case of a shifting roll with two contact zones, if the shifting velocity is less than the smaller of the two limit velocities, the two contact zones are in non-all statical friction states.

The first four cases are based on the four-high rolling mill 10 and the fifth case includes of a middle work roll which would be included in a six-high configuration. In the first case shown in FIG. 8A, there is no contact zone on the shifting roll surface of upper working roll 16. The axial shifting velocity is not limited by the non-all statical friction condition. The velocity of the shifting roll $V_0$ can be determined from the production or technological specifications.

Figure 8A:
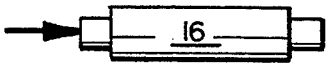
FIGS. 8A–8E shows the various adjustable states of a working roll to be axially shifted.
Figure 8B:
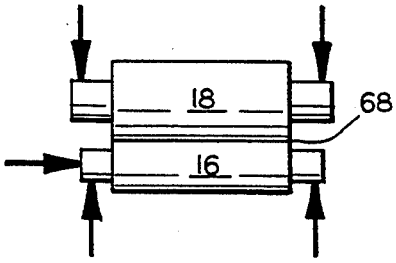

The second case shows an axially shifting upper work roll 16 pressed by an upper back-up roll 18 (FIG. 8B).

The work roll 16 has a single contact zone 68. According to equation (17), the permissible shifting velocity $v_w$ of the upper work roll 16 is given by the following equation:

$$v_w=0.20944kn_wR_w\alpha_{wb}\delta_{0wb}0.5^{\alpha}wb/(2b_{wb}) \quad (19)$$

where k=the velocity coefficient, k<1; subscript "w" represents the work roll and subscript "wb" the contact zone 68 between the upper working roll 16 and the upper back-up roll 18.

Figure 8C:
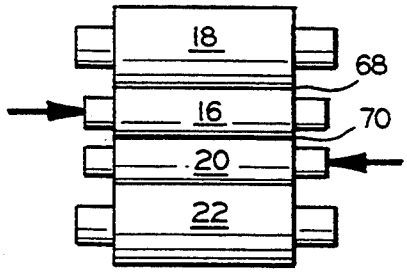

FIG. 8C shows the case where the upper working roll 16 is pressed by the upper back-up roll 18 plus the lower working roll 20 and back-up roll 22. The roll to be axially shifted, working roll 16, has two contact zones 68, 70. The permissible shifting velocity of upper working roll 16 is defined by the following equation:

$$v_w=0.20944kn_wR_w\cdot min\{\alpha_{wb}\delta_{0wb}0.5^{\alpha}wb/(2b_{wb}),0.5\alpha_{ww}\delta_{0ww}0.5^{\alpha}ww/(2b_{ww})\} \quad (20)$$

where subscript "ww" denotes the contact zone 70 between the two work rolls 16, 20.

Figure 8D:
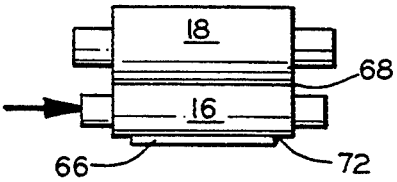

In the fourth case shown in FIG. 8D, the upper working roll 16 is shifted during operation of the rolling mill 10. The working roll 16 has two contact zones, the first contact zone 68 with the upper working roll 18 and a second contact zone 72 with the strip, material 66. The permissible shift velocity of upper working roll 16 during the rolling process is as follows:

$$v_w=0.20944kn_wR_w\cdot min\{\alpha_{wb}\delta_{0wb}0.5^{\alpha}wb/(2b_{wb}),\alpha_{ww}\delta_{0ww}0.5^{\alpha}ws/(2b_{ww})\} \quad (21)$$

where subscript "ws" stands for the rolling deformation zone 72.

Figure 8E:
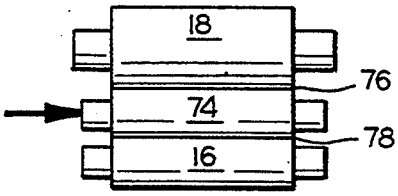

A six-high configuration is similar to the four-high configuration, the main difference being the addition of a middle working roll between each of the working rolls and the back-up rolls. In FIG. 8E, a middle working roll 74 is shown between upper working roll 16 and upper back-up roll 18. The middle working roll 74 is the roll to be shifted, which results in two contact zones 76, 78. The permissible shifting velocity of the middle working roll 74 is as follows:

$$v_m=0.20944kn_mR_m\cdot min\{\alpha_{mb}\delta_{0mb}0.5^{\alpha}mb/(2b_{mb}),\alpha_{mw}\delta_{0mw}0.5^{\alpha}mw/(2b_{mw})\} \quad (22)$$

where subscript "m" represents the middle working roll 74, subscript "mb" represents the contact zone 76 between the middle working roll 74 and the back-up roll 18, and subscript "mw" represents the contact zone 78 between the middle working roll 74 and the upper working roll 16.

The permissible shifting velocity is influenced by the rotational speed, the surface roughness, and the radius of the roll body. In addition, the limit initial displacement and the width of the contact zone, which are related to the rolling parameters, are important factors that influence the permissible shifting velocity. When the shifting roll changes from a transient state to a stable state, there is a slight slip at the edge of the contact zone. The reason for such slippage is that the average unit axial force is greater than the friction force at the edge. However, the change of the practical contact width is not significantly effected by the slippage. The contact width between the upper working roll 16 and the upper back-up roll 18 is as follows (Hertz's formula):

$$2b_{ij}=\sqrt{(16R_iR_j)/(\pi(R_i+R_j))\cdot((1-\mu_i^2)/E_i+(1-\mu_j^2)/E_j)\cdot p_{ij}} \quad (23)$$

where $p_{ij}=(P+2S_1)/L_{ij}$,

E,$\mu$=modulus of elasticity and Poisson's ratio, p, P=the general rolling force and the contact pressure per unit length, $2S_1$=the general bending force of the work roll, L=the practical contact length between two rolls.

Subscripts "i" and "j" indicate two adjacent rolls i and j, and subscript "ij" indicates the contact zone between the two adjacent rolls.

The length of the rolling deformation zone is based on the following application of Hitchcock's formula:

$$2b_{ws}=\sqrt{R_w[\Delta h+(16(1-\mu_w^2)p_{ws})/(\pi E_w)]} \quad (24)$$

where $p_{ws}=P/B$, $\Delta h$, B=the reduction of strip thickness and the width of strip.

According to experimental results, the limit initial displacement can be expressed by the following formula:

$$\delta_{0ij}=\gamma_{ij}f_{ij}(q_{ij})^{60}ij \quad (25)$$

where $q_{ij}=p_{ij}/(2b_{ij})$, $\gamma_{ij}$=the experiment coefficient.

With the changes of the rolling parameters, the range of the permissible shifting velocity of the roll is also changed. After the shifting velocity in every adjustable state is determined, the unit axial friction force of every contact zone can be derived by the equations (14) and (16). Consequently, the general axial force of the roll body is obtained as follows:

$$T_b=2(\beta_{ij}f_{ij}q_{ij}b_{ij}L_{ij}+\beta_{ik}f_{ik}q_{ik}b_{ik}L_{ik}) \quad (26)$$

where subscripts "ij" and "ik" indicate two contact zones on roll i.

In addition to the axial friction force of the roll body, the hydraulic cylinder of the shifting roll still overcomes the friction force $T_f$ on surfaces of other related parts, the axial random force $T_c$ produced by wedge of strip in the lateral direction, deviation of strip in the longitudinal direction and roll crossing in the rolling process, and other forces. $T_f$ and $T_c$ may be measured from existing rolling mills of the same size. The general shifting force of the hydraulic cylinder is equal to the following:

$$T=T_b+T_f+T_c \quad (27)$$

The control systems for the rolling mill 10 include both electrical and hydraulic controllers. The electric controller (not shown) controls the performance of the drive motors 64 for driving the working rolls 16, 20.

Figure 9:
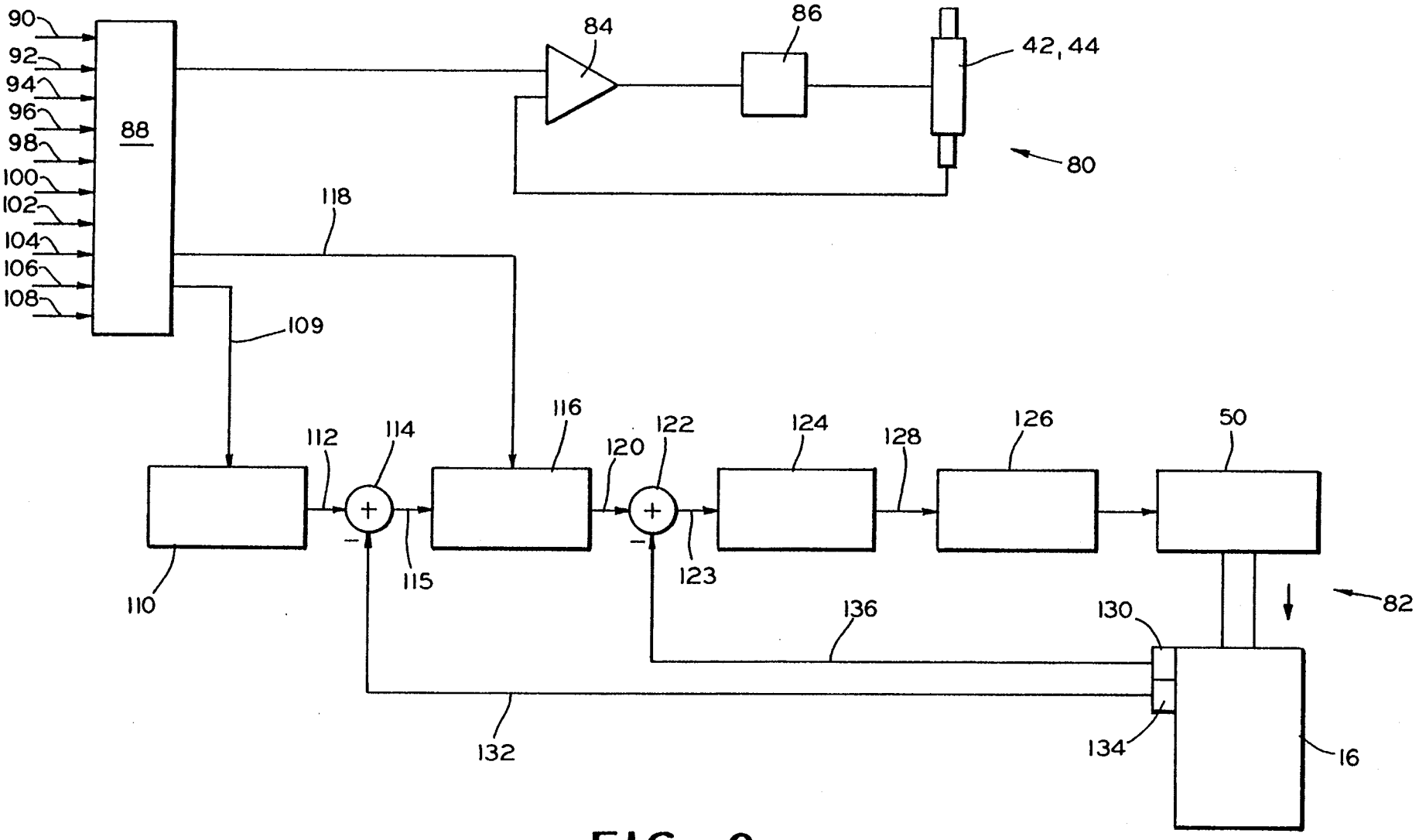
FIG. 9 is a hydraulic control system for a rolling mill, including the axial shifting control system of the present invention.

Two hydraulic control systems 80 and 82, as shown in FIG. 9, are typically used to control the hydraulic cylinders in the rolling mill 10. The roll bending control system 80 is generally a closed-loop servo-valve system to control the operation of hydraulic cylinders 42, 44, which create the roll bending forces on working rolls 16, 20. Pressure regulators 84 and servo valves 86 control the operation of the hydraulic cylinders 42, 44.

Sensors and other similar control mechanisms generate control signals which may be input directly to the regulators 84 or processed by a computer/central processing unit 88 for input to the regulators 84. The control signals for the pressure regulators 84 in the hydraulic control system 80 may include signals from an operator station 90 or operating program which includes information regarding the strip material 66 and the working rolls 16, 20; signals from gauges 92 at the point of entry and exit from the rolling mill 10 to measure the thickness and width of the strip material 66; signals from tension rollers 94 measuring the tension of the strip material 66; signals from position sensors and displacement transducers 96 on the working rolls 16, 20 and from other displacement transducers and position sensors 98, including position sensors 100 on the pistons of the hydraulic cylinders 42, 44, 50; signals from gauges and velocity transducers 102 measuring the rotational speed of the work rolls 16, 20; signals from pressure transducers 104 on the hydraulic cylinders 42, 44 and pressure transducers 106 on the axial shifting hydraulic cylinders 50; and signals from all other sensors 108 measuring additional control related parameters, such as rotational force of the rolls.

The second hydraulic control system is the axial shifting control system 82 of the present invention for controlling the hydraulic cylinders 50 to axially shift the working roll 16. The axial shifting of the working rolls 16, 20 greatly increase the capacity of the rolling mill 10 in controlling the shape of the strip material 66. When the bending of the working rolls 16, 20 as controlled by the roll bending controller 80, is not able to achieve the desired strip shape, or when the working rolls 16, 20 need to be shifted to prevent uneven wearing of the working rolls 16, 20, the axial shifting control system 82 is used to shift the working rolls.

The permissible shifting velocity of a roll is determined by a number of roll parameters, such as rotational speed of the roll, the radius of the roll, the surface roughness and texture, the limit initial displacement, and the width of the contact zone. The range of the permissible shifting velocity changes as the roll parameters change. The parameters which vary during production operations, such as rotational speed of the working roll 16, are monitored and a signal is sent to the central processing unit 88. In cases where the parameters are fixed, such as radius of the roll and the width of the contact zone, the parameters may be entered manually or programmed into the central processing unit 88 at input 96.

The axial shifting control system 82 is a closed-loop servo-valve system. The primary controlling variables for the hydraulic control system 82 for axial shifting of the working rollers 16, 20 are the shifting distance and the shifting velocity, which are determined respectively by the requirements of the shape and profile of the strip 66, and by the non-all statical friction condition. By controlling the axial shifting distance and the shifting velocity, the scarring and scotch marks on the rolls 16, 20 and the strip 66 can be reduced or eliminated.

In order to insure the non-all statical friction condition, the closed-loop of the shifting velocity is taken as the inner loop of the control system 82. Because the shifting distance and the setting accuracy of the shifting roll 16 influences the shape of the strip material 66 and the quality of the finished product, the closed-loop of roll position (shifting distance) is taken as the outer loop of control system 82.

The computer/central processing unit 88 may be programmed to compute the desired time for the axial shifting of the working rolls 16, 20. When the central processing unit 88 receives a signal 90 from an operator station or determines, based on processing of other input signals, that the rolls 16, 20 are to be axially shifted, an input signal 109 is transmitted to displacement converter 110. The central processing unit 88 is programmed to calculate the axial distance for the roll 16 to be shifted and to transmit an appropriate voltage signal 109. The displacement converter 110 generates an output voltage signal 112 which is transmitted to potentiometer 114. The potentiometer 114 also receives a shifting velocity feedback signal 132 to transmit an output voltage signal 115 to the velocity controller 116.

The central processing unit is programmed to generate another control signal 118 based on current rolling parameters which are inputted into the central processing unit 88, such as rolling force, bending force, rotational speed, width and thickness reduction of the strip material 66, and other inputs noted above. The velocity controller 116 determines a voltage increment per unit of time and transmits such a signal 120 to potentiometer 122. The potentiometer 122 also receives a shifting velocity feedback signal 136 to transmit a voltage increment per unit time signal 123 to the servo amplifier 124. The amplifier 124 converts the voltage increment per unit time signal 123 into an electric current increment signal 128, which is transmitted to the servo valve 126. The servo valve 126 regulates a fluid flow increment which feeds into the hydraulic cylinders 50 to shift the working roll 16 in an axial direction. The movement of the pistons in cylinders 50 will impart the force necessary to achieve the desired shifting distance at the desired shifting velocity.

Because the goal is to control the shifting distance and the shifting velocity of the working roll 16, the actual shifting distance is fed back to potentiometer 114 by a voltage signal 132 from displacement transducer 134 and the actual shifting velocity is fed back to potentiometer 122 by a voltage signal 136 from velocity transducer 130. The closed-loop system is adjusted until the desired shifting distance and shifting velocity is obtained.

Once the working roll 16 is shifted for the specified distance, the central processing unit 88 turns off the control signals 109 and 118 to shut down the axial shifting control system 82 until the working roll 16 is to be shifted to a new position.

Figure 10:
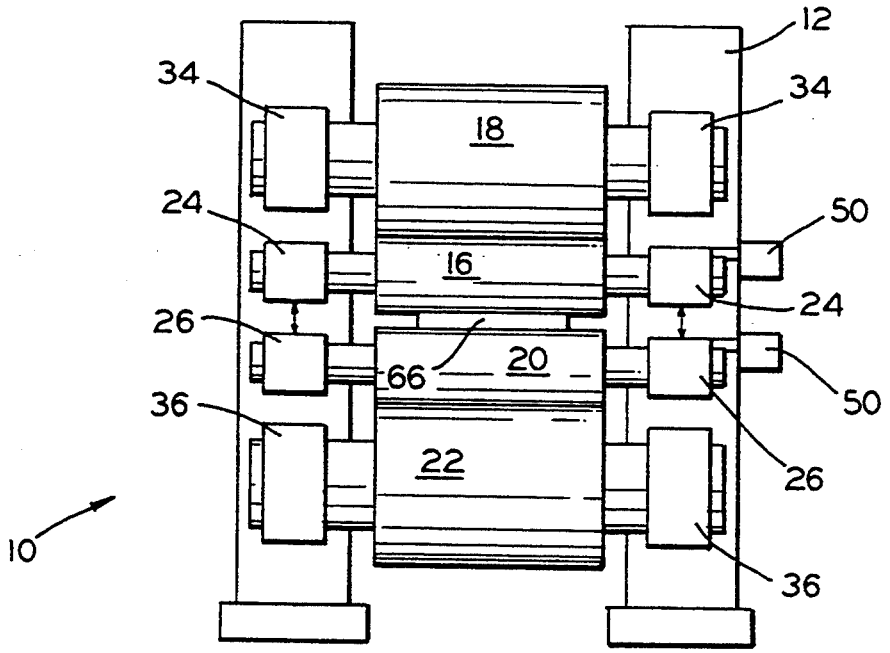
FIGS. 10–11 show a four-high rolling mill having the working rolls aligned in a non-shifted position in FIG. 10, and having the working rolls in a relatively shifted position in FIG. 11.
Figure 11:
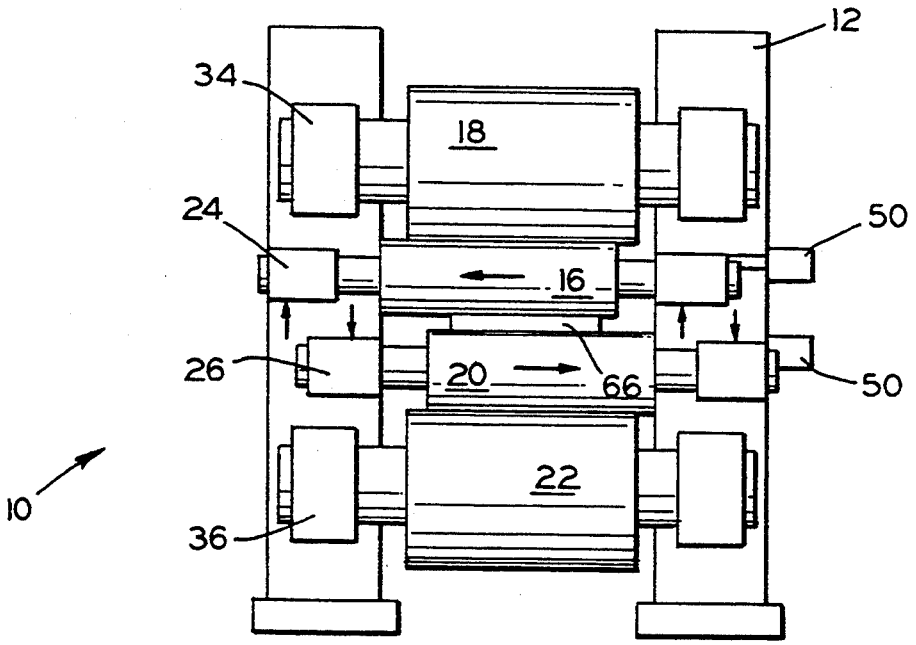

A general example of a four-high rolling mill 10 in operation for processing a strip material 66 when the working rolls 16, 20 are not relatively shifted is shown in FIG. 10. In addition, FIG. 11 shows the same rolling mill 10 after both working rolls 16, 20 have been axially shifted by the axial shift hydraulic cylinders 52.

The rolling mill 10 includes a set of hydraulic cylinders for bending the working rolls 16, 20. When the profile of the work rolls 16, 20 is flat, the rolling mill 10 corresponds to a HCW mill. When such profile is curvilinear, the rolling mill corresponds to a CVC mill. The maximum shifting distance of the working rolls 16, 20 is ±30 mm.

The basic geometric and characteristic parameters of the rolling mill 10 are inputted to the central processing unit for calculating the desired axial shifting distance and the desired shifting velocity, and for generating the appropriate control signals 109, 118. The diameter of the working rolls 16, 20 is 90 mm, and the diameter of the back-up rolls 18, 22 is 200 mm. The length of all rolls is 300 mm and the bending force applied to the working rolls 16, 20 is 40 kN. The modulus of elasticity is 220 GPa, Poisson's ratio is 0.3, and the surface roughness coefficient is 1.9.

In the normal cold rolling state, the rotational speed of the working roll 16 is 300 rpm. The statical friction coefficient is 0.1. When the unit of normal pressure q is $N/mm^2$, the experimental coefficient $\gamma_{ij}$ of the limit initial displacement is taken as approximately 0.005. In order to consider the axial random force applied on the working roll 16 in the rolling process, the velocity coefficient k is taken as 0.8. When the working roll 16 is at zero point, the entire length of the working roll 16 is in contact with the strip material 66. Strip width B is 250 mm, and the strip thickness reduction $\Delta h$ is 0.3 mm. The permissible shifting velocity $v_w$ and the axial shifting force $T_b$ can now be calculated.

In the configuration where an axially shifting upper work roll 16 is pressed only by an upper back-up roll 18 (FIG. 8B), the work roll 16 has a single contact zone 68. The work load is equal to 5.0 kN. The limit initial displacement is 3.510 mm, the axial force coefficient $\beta$ equals 0.431, the permissible velocity $v_w$ is 16.03 mm/s, and the axial force of the working roll $T_b$ equals 0.216 kN.

Where the upper working roll 16 is pressed by the upper back-up roll 18 plus the lower working roll 20 and back-up roll 22 (FIG. 8C), working roll 16 has two contact zones 68, 70. The work load is equal to 55.0 kN for contact zone 68 between the working roll 16 and the upper back-up roll 18, and is equal to 50.0 kN for the contact zone 70 between the working roll 16 and the working roll 20. The limit initial displacement is 5.790 mm and 5.680 mm, respectively. The axial force coefficient $\beta$ equals 0.259 for contact zone 68 and 0.431 for contact zone 70. The permissible velocity $v_w$ is 4.090 mm/s in contact zone 70. The axial force of the working roll $T_b$ equals 3.579 kN.

In the configuration shown in FIG. 8D, the upper working roll 16 is shifted during operation of the rolling mill 10. The working roll 16 has two contact zones, the first contact zone 68 with the upper working roll 18 and a second contact zone 72 with the strip, material 66. The work load is equal to 430.0 kN for contact zone 68 between the working roll 16 and the upper back-up roll 18, and is equal to 400.0 kN for the contact zone 72 between the working roll 16 and the strip material 66. The limit initial displacement is 8.900 mm and 6.140 mm, respectively. The axial force coefficient $\beta$ equals 0.140 for contact zone 68 and 0.431 for contact zone 72. The permissible velocity $v_w$ is 1.110 mm/s in contact zone 72. The axial force of the working roll $T_b$ equals 23.257 kN.

Figure 12:
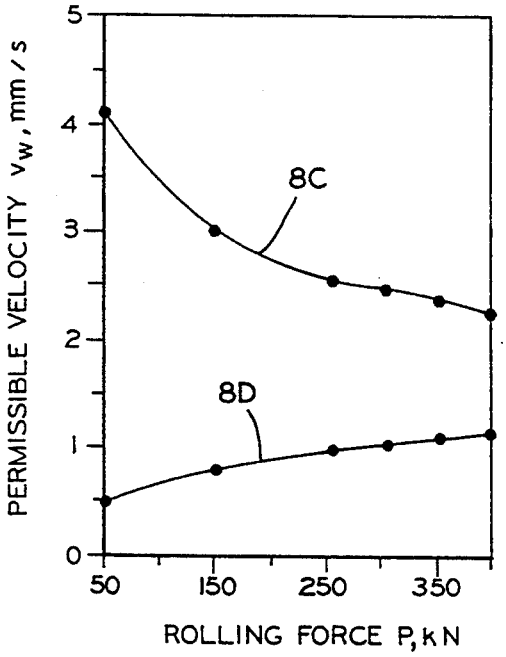
FIGS. 12–13 are graphs showing the variance of the permissible velocity (FIG. 12) and the variance of the axial force (FIG. 13) as a function of the rolling force.
Figure 13:
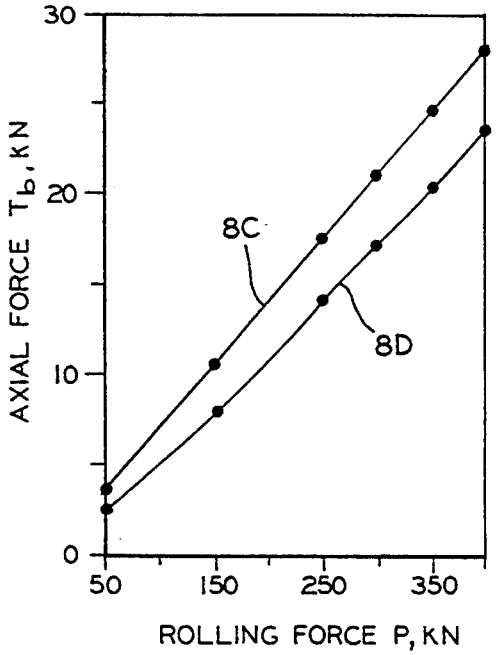
Figure 16:
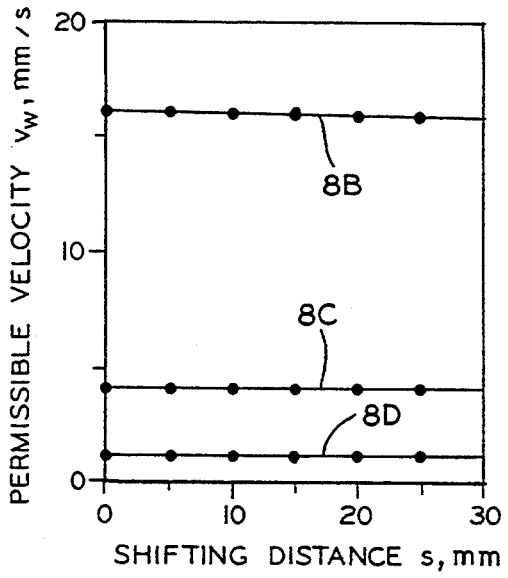
FIGS. 16–17 are graphs showing the variance of the permissible velocity (FIG. 16) and the variance of the axial force (FIG. 17) as a function of the shifting distance.
Figure 17:
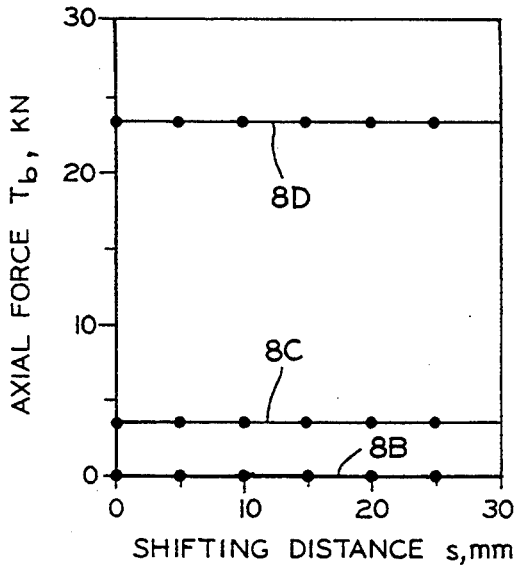

Under the above calculating conditions and roll configurations, the relationship of permissible shifting velocity versus rolling force, and of axial shifting force versus rolling force are shown in the graphs of FIGS. 12 and 13. The graphs in FIGS. 14 and 15 display the relationship of the permissible shifting velocity and the axial shifting force versus the bending force. The next two graphs in FIGS. 16 and 17 show the relationship of the permissible velocity and the axial shifting force as the shifting distance varies from 0 to 30 mm.

In the cases where the upper working roll 16 has two contact zones, the permissible shifting velocities of the working roll 16 are determined by the contact zone 70 between the upper working roll 16 and the lower working roll 20 in FIG. 8C and by the contact zone 72 between the upper working roll 16 and the strip material 66 in FIG. 8D. The contact width and the limit initial displacement influence the permissible shifting velocity.

FIG. 12 shows that the permissible velocity decreases in configuration 8C due to the increase in contact width. In the configuration of 8D, the permissible velocity increases based on the constant rolling deformation length and increase of the limit initial displacement.

Observing FIG. 13, the increase of the rolling force P increases the axial forces in both configurations 8C and 8D.

Figure 14:
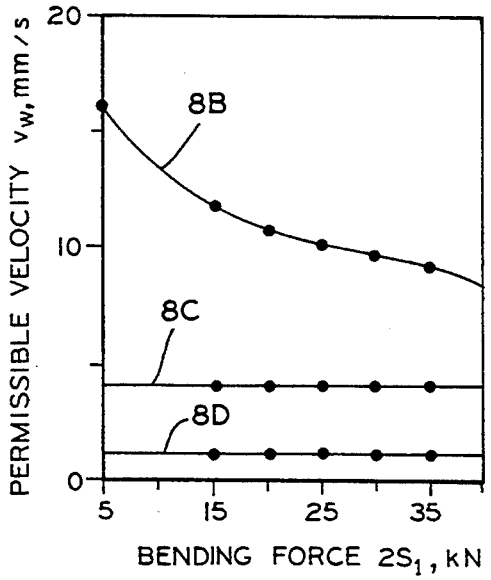
FIGS. 14–15 are graphs showing the variance of the permissible velocity (FIG. 14) and the variance of the axial force (FIG. 15) as a function of the bending force.

In FIG. 14, as the bending force of the working roll 16 increases, the permissible velocity in configurations 8B decrease, but the permissible velocities in configurations 8C and 8D remain constant. The primary reason is that the bending force of the working roll 16 only influences the permissible velocity of the contact zone 68 between the working roll 16 and the back-up roll 18.

Figure 15:
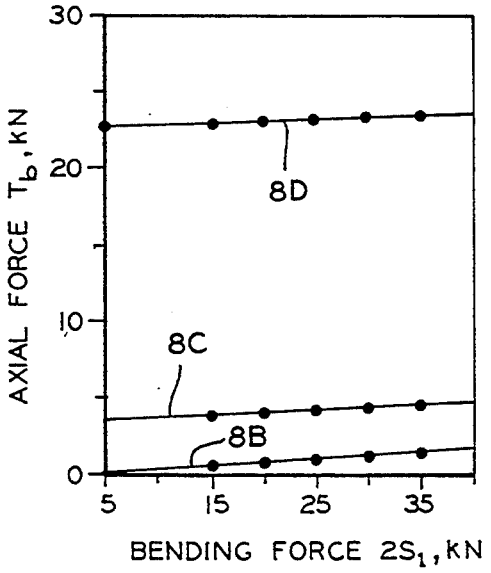

Observing FIG. 15, the axial forces increase as the bending force of working roll 16 increases for all three configurations 8B, 8C and 8D.

FIGS. 16 and 17 show that the permissible velocities and the axial forces do not change significantly as the shifting distance increases.

According to experimental results, the sum of the friction force $T_f$ and the axial random force $T_c$ is less than 3 kN. From FIG. 13, the maximum $T_b$ is 27.5 kN, which results in a general shifting force of the hydraulic cylinder equal to approximately 31.5 kN.

For configurations 8B, 8C, and 8D, the permissible shifting velocity is controlled by the curves shown in FIGS. 12, 14, and 16.

The axial shifting control system 82 of FIG. 9, when applied to the rolling mill 10 shown in FIGS. 10 and 11, eliminates scarring and scotch marks on the roll surfaces. The closed-loop system for shifting velocity is combined with the closed-loop system for shifting displacement control to provides an improved axial shifting control system 82. The control system is applicable for work rolls with flat or curved profiles.

Figure 18:
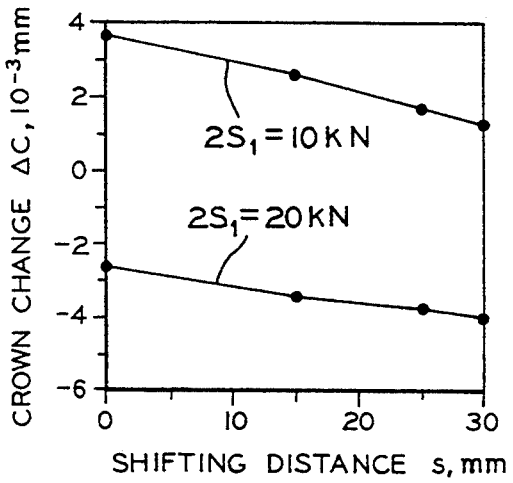
FIG. 18 is a graph showing the controlling range of the strip crown in a rolling mill provided with working rolls in a flat profile.

FIG. 18 shows the controlling range of the strip crown when the work rolls 16, 20 have a flat profile. The strip crown change, $\Delta C$, is the difference of the crown of the strip 66 after rolling. In FIG. 18, B=200.0 mm; H=0.735 mm; $\epsilon$=0.13; and P=320.0 kN.

Figure 19:
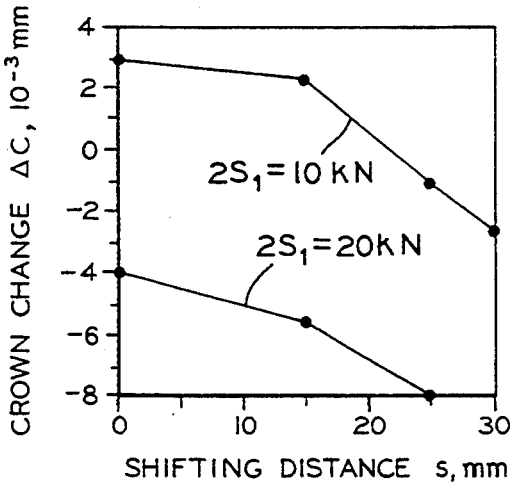
FIG. 19 is a graph showing the controlling range of the strip crown in a rolling mill provided with working rolls in a sinuous profile.

When the work rolls are adopted in the sinuous profile and the diameter difference of the work roll body is 0.014 mm, the strip crown change is shown in FIG. 19. In FIG. 19, B=200.0 mm; H=0.740 mm; $\epsilon$=0.10; and P=250.0 kN.

The axial shifting control system 82 enlarges the capacity of the rolling mill 10 for controlling strip shape. The axial force and the permissible shifting velocity are rationally designed by using the initial displacement principle. The non-all statical friction condition is assured by controlling the axial shifting velocity, which effectively avoids the faults in the strip caused by the work roll shifting, and which reduces the uneven wear of the working rolls. The axial shifting control system 82 enhances the quality of the strip material 66 and extends the life of the working rolls.

Rolling force is a principal factor that influences the axial force and the permissible shifting velocity. In the rolling process, the axial shifting force and the permissible shifting velocity reach their maximum values in various adjustable states. Because the compensatory ratio of the permissible shifting velocity is less than that of the axial force, it is necessary that the closed loop of the shifting velocity is used in the control system.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A process for controlling the axial shifting of a roll in a rolling mill during the processing of a strip material, said roll having at least one contact zone, the process comprising the following steps:

a) controlling an axial shifting distance of a roll in the rolling mill by a closed loop control system, said control system including an outer loop for determining the axial shifting distance of said roll to maintain a specified shape of the strip material during processing in the rolling mill; and b) simultaneously controlling an axial shifting velocity of said roll by said closed loop control system, said control system including an inner loop for determining the axial shifting velocity to maintain the contact zone of said roll in a non-all statical friction condition during the axial shifting of said roll, whereby scarring and scotch marks on said roll and the strip material are avoided.

2. A process for controlling the axial shifting of a roll in a rolling mill during the processing of a strip material, said roll having at least one contact zone, the process comprising the following steps:

a) monitoring the shape of the strip material being processed in the rolling mill, and monitoring the rolling parameters of said roll in the rolling mill to obtain information;

b) transferring information from a plurality of monitors to a central processing unit;

c) processing information and transmitting a strip shape control signal from the central processing unit to a displacement converter;

d) transmitting a displacement control signal from the displacement converter to a velocity controller;

e) transmitting a rolling parameters control signal from the central processing unit to the velocity controller;

f) processing the displacement control signal and the rolling parameters control signal to generate a servo voltage signal providing a voltage increment per unit of time;

g) transmitting the servo voltage signal to the servo amplifier and valve;

h) regulating a fluid flow increment being transferred to at least one hydraulic cylinder for axially shifting said roll at a specified velocity;

i) measuring the actual displacement distance and the actual shifting velocity to generate a displacement feedback signal and a velocity feedback signal; and j) adjusting the displacement control signal based upon the displacement feedback signal and adjusting the servo voltage signal based upon the velocity feedback signal.

3. The process for controlling the axial shifting according to claim 2 including the initial step of programming a central processing unit to calculate the permissible shifting velocity and the axial shifting force.

4. The process for controlling the axial shifting according to claim 2 wherein the step of monitoring the rolling parameters includes monitoring the roll to determine a rotational speed, a surface roughness, a radius of the roll body, and a width of the contact zone.

5. The process for controlling the axial shifting according to claim 2 wherein the step of monitoring the shape of the strip material includes measuring the thickness of the strip material before and after the rolling process.

6. The process for controlling the axial shifting according to claim 2 wherein the axial shifting control system controls two rolls and the servo valve regulates hydraulic cylinders for the axial shifting of both of said rolls.

* * * * *